United States Patent [19]

Hammer

[11] 3,955,698

[45] May 11, 1976

[54] NURSING BOTTLE FOR COLLAPSIBLE LIQUID CONTAINERS

[76] Inventor: Ilse M. Hammer, 46 Place Kieffer, Dollard des Ormeaux, Canada

[22] Filed: Jan. 13, 1975

[21] Appl. No.: 540,543

[52] U.S. Cl. ..... 215/11 E

[51] Int. Cl.[2] ..... A61J 9/00

[58] Field of Search ..... 215/11 E, 11 R; 222/95, 222/391

[56] References Cited

UNITED STATES PATENTS

| | | | |
|---|---|---|---|
| 720,902 | 2/1903 | Du Brau | 222/95 |
| 978,892 | 12/1910 | Janssen | 215/11 E UX |
| 2,469,489 | 5/1949 | Allen | 215/11 R |
| 2,793,778 | 5/1957 | Maxwell | 215/11 R |
| 3,335,913 | 8/1967 | Bouet | 222/95 |
| 3,561,644 | 2/1971 | Works | 222/95 |
| 3,648,873 | 3/1972 | Grobbel | 215/11 E |
| 3,822,806 | 7/1974 | Grimes | 215/11 E |

*Primary Examiner*—Donald F. Norton
*Attorney, Agent, or Firm*—Diller, Brown, Ramik & Wight

[57] ABSTRACT

A nursing bottle comprising a tubular housing having at least one open end. Engageable means is provided for retaining a collapsible liquid container in the housing. Movable support means are provided in the housing and biased in the direction of the open end of the housing for collapsing empty portions of the container against its liquid content.

13 Claims, 6 Drawing Figures

Fig. 3
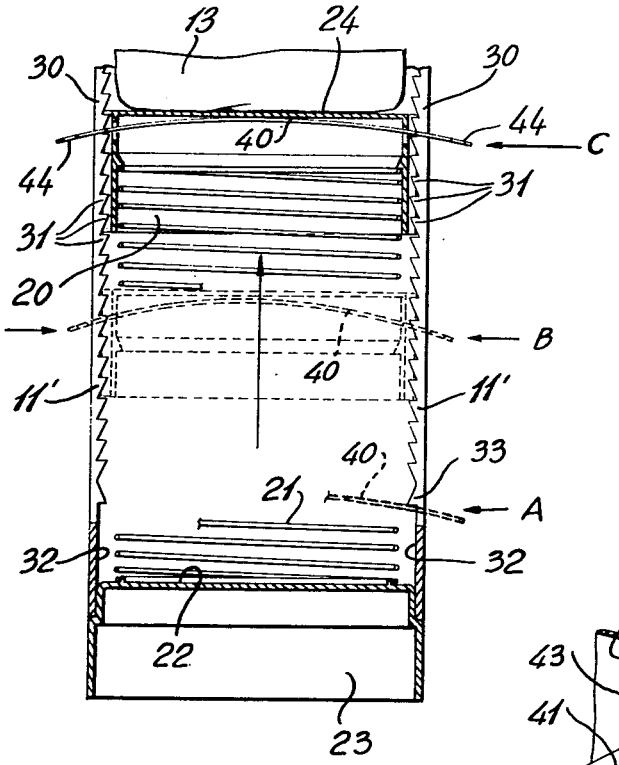
Fig. 5
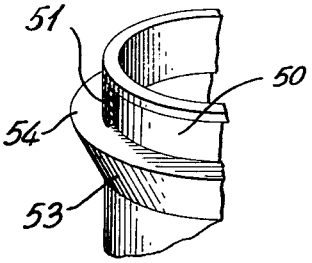
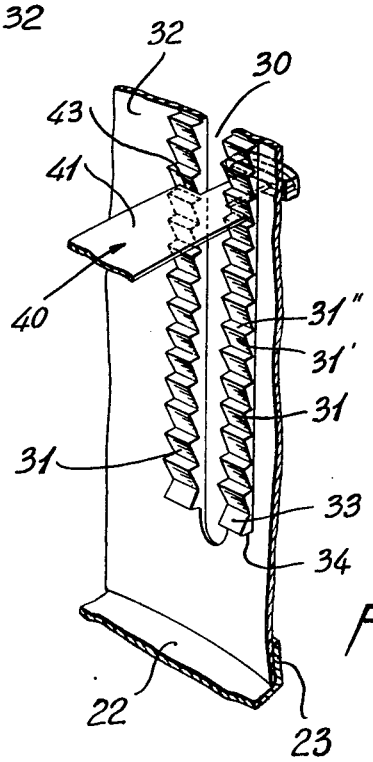
Fig. 4
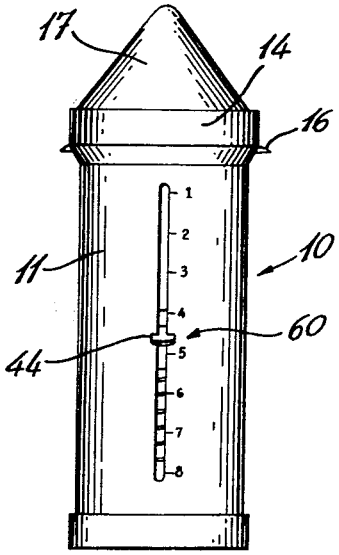
Fig. 6

NURSING BOTTLE FOR COLLAPSIBLE LIQUID CONTAINERS

BACKGROUND OF THE INVENTION

1. Field of the Invention

The present invention relates to an improved nursing bottle construction particularly adapted for holding a collapsible liquid container therein.

More particularly, but not exclusively, the present invention relates to a nursing bottle particularly adapted for engaging and retaining a collapsible liquid container as described in my co-pending U.S. Patent application Ser. No. 400,383, filed on Sept. 24, 1973 and now U.S. Pat. No. 3,871,542.

2. Description of the Prior Art

In the prior art various types of cylindrical bottles have been provided for holding therein liquid containers of the collapsible or non-collapsible type. These containers consist in most cases of a hollow cylindrical body having an open end with a clamping ring provided thereabout whereby to retain a nipple element over an open-ended container which is retained in the bottle. Also, the clamping ring holds the nipple end and the open-ended container in sealed relationship. As the liquid is dispensed from the container, air will enter the container particularly when the nipple end is removed from the infant's mouth. Thus, air becomes entrapped in the container and will be dispensed with the liquid causing the infant to have gas. Also, the sealing arrangement between the nipple end and the container is sometimes imperfect causing the liquid to seep out through the clamping ring and further resulting in air leaking into the container. Further, these type of containers are time consuming when assembling same in a bottle holder.

SUMMARY OF THE INVENTION

It is a feature of the present invention to provide an improved nursing bottle which substantially overcomes the above mentioned disadvantages.

According to a broad aspect, the present invention provides a nursing bottle comprising a tubular housing having at least one open end. An engageable means is provided for retaining a collapsible liquid container in the housing. An elongated slot is formed through a sidewall of the housing and extends longitudinally in a portion of the sidewall. A spring biased movable support member in provided in the housing and biased in the direction of the open end for collapsing empty portions of the container against its liquid content. Frictional means is engageable by the movable support member and displaceably engageable with an inner surface of the tubular housing and has a portion thereof extending through the slot.

BRIEF DESCRIPTION OF THE DRAWINGS

The invention will now be described with reference to a preferred embodiment as illustrated in the accompanying drawings. This embodiment is for illustration purposes only and various modifications thereof which fall within the ambit of the invention as above summarized and as defined in the claims, are intended to be covered.

In the drawings:

FIG. 3 is a fragmented section view illustrating the operation of the movable support means and frictional means;

FIG. 4 is a fragmented perspective view showing the elements constituting the frictional means;

FIG. 5 is a fragmented perspective view of a modification of the engageable rim at the open end of the bottle, and FIG. 6 is a side view of the nursing bottle of the present invention shown with a particular collapsible liquid container secured therein.

DESCRIPTION OF THE PREFERRED EMBODIMENTS

Figure 1:
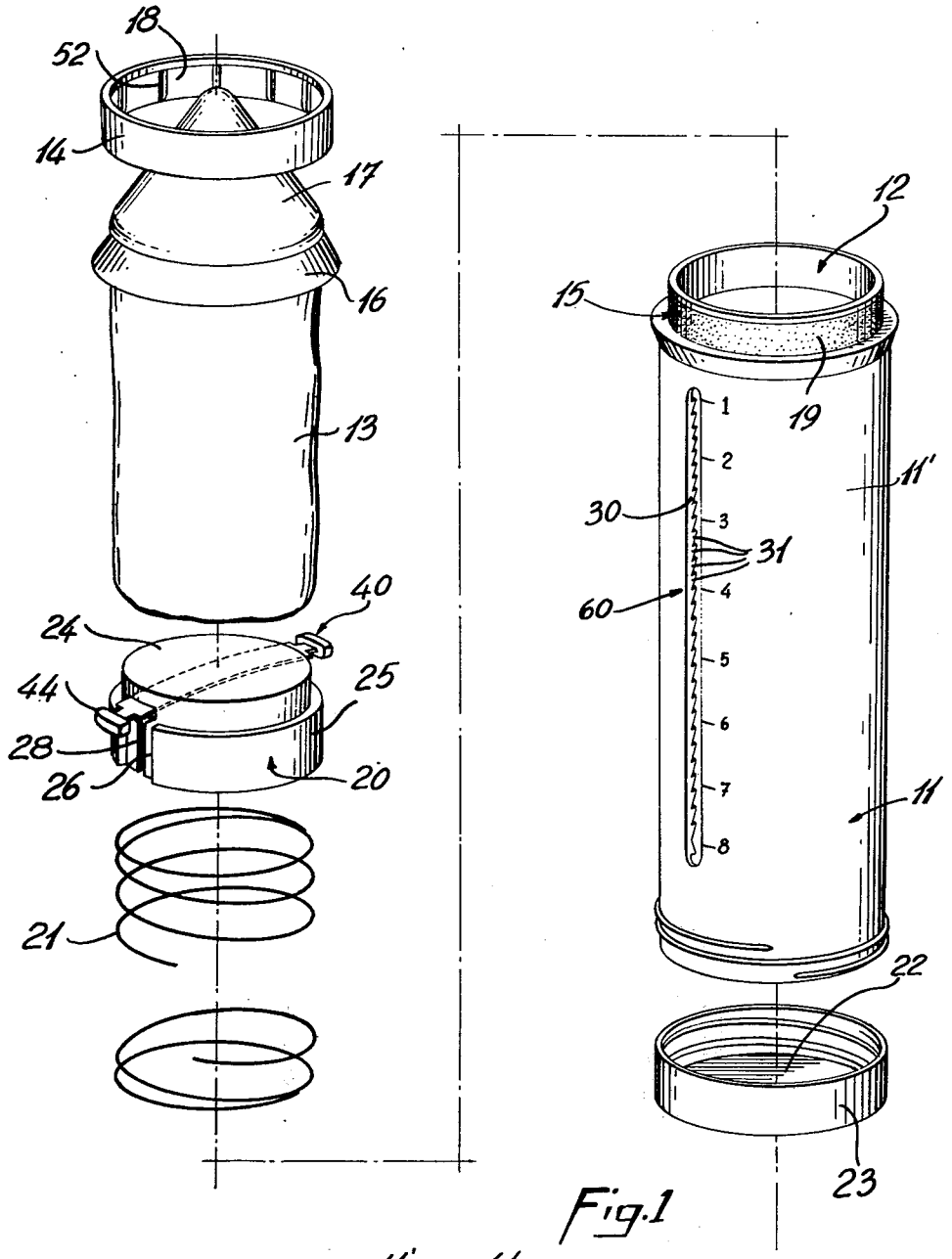
FIG. 1 is an exploded view of the various parts of the nursing bottle and the particular collapsible liquid container.
Figure 2:
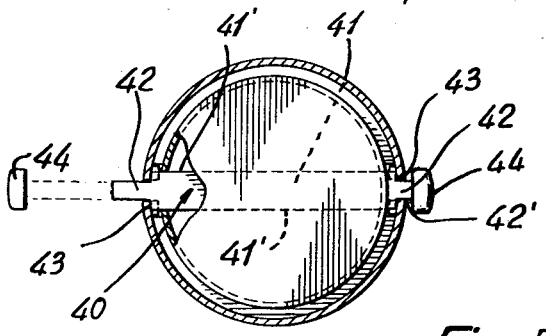
FIG. 2 is a top fragmented view showing the arrangement of the movable support means and frictional means.

Referring now to the drawings and more particularly to FIGS. 1 and 6, there is shown generally at 10 the nursing bottle of the present invention. The nursing bottle comprises a tubular housing 11 having at least one open end 12 for the insertion of a collapsible liquid container of the type shown at 13, or other suitable types. Engageable means, hereinshown having a clamping ring 14, is adapted to be removably engaged over the engageable rim 15 about the upper open end 12 of the housing 11. In this particular embodiment the clamping ring 14 secures a skirt 16 attached adjacent the nipple end 17 of the collapsible container 13. The container 13 is positioned in the open end with the skirt 16 extending over the engageable rim 15 and the clamping ring 14 is then pushed in tight fit thereover clamping the skirt 16 between the inner wall 18 of the ring 14 and the outer wall 19 of the engageable rim 15. The surface of the outer wall 19 may be a smooth surface or roughened for clamping purposes.

A movable support means hereinshown having a base member 20 is positioned within the hollow cylindrical housing 11 and biased towards the open end 12 by a coil spring 21 which is disposed between a bottom end wall 22, of a screw base member 23, and the underface of the base member 20. The reason for the base member 20 is to collapse empty portions of the container 13 against its liquid content whereby to prevent air from being admitted into the container whilst the liquid being dispensed, and to prevent the nipple end 17 from collapsing (depending on the type of container utilized) due to a lack of liquid in the nipple region of the container. The pressure applied by the base member is only sufficient to collapse the container wall from the rear portion thereof as liquid is being dispensed. There is not sufficient pressure applied by the base member to force the liquid out of the container through the opening which is normally provided in the nipple end 17. When the bottle is placed in the vertical position, the liquid in the container 13 will push the base member 20 towards the end wall 22.

Referring now more particularly to FIGS. 1 to 4, there is shown the construction of the tubular housing and the movable support base member 20. The housing 11 is an elongated cylindrical housing provided with an elongated slot 30 extending along a portion of the length of the side wall 11' thereof and parallel to its longitudinal axis. A plurality of ridges 31 are formed in the inner surface 32 of the housing, on each side of the slot 30. As shown in the embodiment described, two such slots 30 are provided and these are diametrically opposed to each other. Ridges 31 are also provided on each side of the diametrically opposed slots (see FIG. 3). As shown the ridges 31 are positioned side by side and define a saw-tooth edge on each side of the slots 30. Each ridge 31 is of triangular cross section and defines a gentle sloping surface 31' and an abrupt sloping surface 31''. A bottom retaining ridge 33 is provided on at least one side of the slots 30 and has a transverse wall 34 whereby to retain frictional means which is hereinbelow described.

The base member 20 is hereinshown as constituted by an inverted cup member having a flat outer face 24 and an underface (not shown). A portion of the side wall 25 of the base member 20 is adapted to be closely spaced to the inner wall 32 of the housing 11 and is provided with two guide channels 26 which are diametrically opposed and adapted to permit passage of the ridges 31 therethrough and which are provided on each side of a respective one of the slots 30. A T-shape slot 28 is provided in each channel 26 and in transverse alignment to receive and retain a friction element 40 therethrough.

A frictional means, hereinshown as a friction element 40 is suitably positioned within the base member 20, within the aligned slots 28, whereby to engage the ridges 31 and cause frictional movement of the base member towards the upper open end 12 of the housing 11 or to cause retention of the base member in the bottom portion of the housing 11. The friction element 40 is a leaf spring having a main body portion 41 which is wider than the width of each of the slots 30. A narrower end portion 42 of the friction element protrudes through a respective one of the slots 30. Each end portion 42 is centrally disposed relative to the body portion 41 whereby a shoulder 43 is defined between each side edge 42' of the end portion 42 and a side edge 41' of the main body portion 41. The main body portion 41 is longer than the transverse distance between the slots 30 whereby each shoulder 43 is urged in frictional contact with the ridges 31, by the bending action of the leaf spring, and along a respective side of the slots 30. The shoulders 43 are caused to be displaced inwardly of the inner wall 32 of the housing 11 and away from its associated ridges 31, by the application of inward pressure from both ends of the leaf spring 40. The ends of the leaf spring 40 are hereinshown as having an enlarged end cap portion 44 removably secured thereto whereby to facilitate the application of pressure towards the center of the bottle by grasping opposed ends between the fingers and applying inward pressure and also for assembling the spring 40 in the housing 11 and member 20.

Referring now to FIG. 5, there is shown a modification of the housing 11 and wherein a groove 50 is formed about the housing 11 and adjacent the open end 12. A resilient band 51 is retained in the groove 50 whereby to provide a better clamping surface with the inner wall 18 of the clamping ring 14. As shown in FIG. 1, a plurality of spaced apart vertical ribs 52 may be provided in the inner wall 18 of the clamping ring 14. These ribs provide pressure points on the resilient band 51 throughout the circumference of the ring whereby to more strongly retain the skirt portion 16 of the collapsible container 13. Also, an outwardly protruding ridge 53 having a horizontal upper surface 54 may be provided immediately below the band 51 whereby the skirt 16 of the container 13 will assume a right angle when the clamping ring is engaged about the upper open end of the housing 11. With the shoulder.portion 53, it may not be necessary to provide the resilient band feature.

Various other modifications to the nursing bottle as herein disclosed are possible and some of these are now being briefly described. For example, the frictional element 40 may be suitably modified and arranged with the base member 20 whereby only one end would extend through a single slot 30. Thus, only one slot 30 would be provided with ridges on one or both sides thereof. Still further the frictional element 40 may be positioned independently of the base member i.e. positioned above the base member and engageable between the slots whereby to restrict movement of the base member. Thus, the liquid container end wall would rest on the frictional element and the outer surface 24 of the base member 20. Further, although guide channels 26 have been described these are not essential to the operation of the base member 20 as the member 20 may be of smaller diameter. Still further, ridges may be provided on one side only of the opposed diametrical slots 30. In such a case it would be preferable that the ridges be provided on opposed sides whereby the frictional element 40 may be stabilized as it rides up the ridges. Still further, it may be possible to provide ridges integrally formed within the surface of the inner side wall of the housing 11, if the side wall 11' is of sufficient thickness. The ridges 31 shown are also integrally molded with the housing 11.

As shown in FIGS. 1 and 6, a scale 60 may be provided along the length of the slot 30 whereby to indicate the amount of liquid present in the container 13. The indication would be provided by the end 44 of the frictional element 40. Thus, the frictional element also acts as a gauge whereby to indicate the amount of liquid present in the container 13 as the liquid is being dispensed. Such an indication would be very accurate as the base member 20 has collapsed the empty portions of the container against its liquid contents and this is continuously performed as the content is being dispensed. The upper region of the base member 20 may be extended whereby the flat outer surface 24 will assume a particular position relative to the upper end of the container 13 whereby substantially one ounce of liquid would be left in the upper end region of the container 13 when the frictional element 40 has reached the end of its upward travel, being the upper ends of the slots 30.

It can also be seen that the nursing bottle of the present invention can be utilized with known prior art containers wherein an open ended collapsible bag is positioned within the nursing bottle with the upper edge of the bag turned about the engageable rim 15. A nipple (not shown) as is normally utilized with such bottles would then be engaged over the outer periphery of the engageable rim 15 by a suitable clamping ring. The clamping ring would be sufficiently tight about the rim 15 whereby to hold the nipple (not shown) in frictional contact with the outer periphery of the engageable rim 15 to prevent leakage.

The operation and use of the nursing bottle of the present invention will now be described with particular reference to FIGS. 1 and 3. Before inserting the liquid container 13 into the housing 11, inward pressure is applied between the outer ends 44 of the friction element 40 and the element 40 is slid down the slits 30 to the bottom thereof and then released whereby the shoulders 43 will engage under the bottom retaining ridge 33. The container is then attached within the housing 11, as previously described, and may be left in this position until the nursing bottle is ready for use, a which time, inward pressure is again applied between the ends 44 of the friction element 40 releasing the base member 20. Spring pressure caused by the helical spring 21 will cause the base member 20 to move towards the open end 12 of the housing until the outer face 24 of the base member is in contact with the rear wall of the container 13. The pressure in the spring 21 is not sufficient to squeeze the liquid out of the nipple end of the container but merely collapses the rear end of the container 13 as the liquid is being dispensed therefrom when the housing is positioned in a dispensing position, i.e., horizontally or extending angularly upward from the open end 12. This type of container is normally formed from plastic film such as polyethylene, or other suitable collapsible material.

As shown in FIG. 3, position A denotes the friction element 40 in its locked position under the bottom retaining ridge 33. Position B shows the friction element 40 in its position of travel towards the upper open end of the container 11. Position C shows the frictional element 40 when the shoulders thereof lie at the bottom of the sawtooth shaped ridges 31 and with the base member 20 having its outer face 24 in contact with the rear wall of the liquid container 13.

I claim:

1. A nursing bottle comprising a tubular housing having at least one open end, engageable means for retaining a collapsible liquid container in said housing, an elongated slot formed through a sidewall of said housing and extending longitudinally in a portion of said sidewall, a spring biased movable support member in said housing biased in the direction of said open end for collapsing empty portions of said container against its liquid content, frictional means engageable by said movable support member and displaceably engageable with an inner surface of said tubular housing, said frictional means having a portion thereof extending through said slot.

2. A nursing bottle as claimed in claim 1 wherein a plurality of ridges are formed in said housing inner surface on each side of said elongated slot, said frictional means further being in frictional engagement with said ridges and displaceable relative thereto by said spring biased member.

3. A nursing bottle as claimed in claim 2 wherein said spring biased member has a flat outer face and an underface, a helical spring disposed between said underface and a bottom end wall of said tubular housing, said frictional means being engageable by said spring biased member.

4. A nursing bottle as claimed in claim 1 wherein two diametrically opposed elongated slots are formed in a sidewall of said tubular housing, said slots extending longitudinally in a portion of said sidewall, a plurality of ridges formed in said housing inner surface along at least one side of each said slots, said frictional means having a portion thereof extending through each said slots, said frictional means further being in frictional engagement with said ridges and displaced relative thereto by said spring biased member.

5. A nursing bottle as claimed in claim 4 wherein said spring biased member has a flat outer face and an underface, a helical spring disposed between said underface and a bottom end wall of said tubular housing, said frictional means being engageable by said spring biased member, and opposed guide channels on a sidewall of said spring biased member for receiving said ridges therethrough and for alignment in said housing.

6. A nursing bottle as claimed in claim 5 wherein said frictional means is a leaf spring having a main body portion wider than the width of each said slots and an end portion protruding through a respective one of said slots, each said end portion being centrally disposed whereby to define a shoulder between each side edge thereof and a side edge of said main body portion, said main body portion being longer than the transverse distance between said slots whereby each shoulder is urged in frictional contact with ridges along a respective side of said slots.

7. A nursing bottle as claimed in claim 6 wherein said shoulders may be caused to be displaced inwardly of said housing away from its associated ridges by the application of pressure from both ends of said leaf spring inwardly of said body.

8. A nursing bottle as claimed in claim 7 wherein said plurality of ridges are positioned side-by-side, said ridges defining a saw tooth edge on each side of said slots.

9. A nursing bottle as claimed in claim 8 wherein each ridge is of triangular cross-section defining a gentle sloping surface and an abrubt sloping surface, said leaf spring being displaced in a direction from said housing bottom end wall to said open end whereby said shoulders move upwardly on said gentle sloping surfaces of said ridges.

10. A nursing bottle as claimed in claim 9 wherein a bottom retaining ridge is provided on at least one side of said slots and having a transverse wall whereby to retain a shoulder of said leaf spring thereunder to prevent displacement of said leaf spring and spring biased member in said housing.

11. A nursing bottle as claimed in claim 4 wherein said tubular housing is a cylindrical tube of circular cross-section, a removable bottom member secured at one end of said tube and defining a bottom wall.

12. A nursing bottle as claimed in claim 1 wherein said engageable means is a clamping ring adapted for frictional tight fit about said open end of said tubular housing.

13. A nursing bottle as claimed in claim 12 wherein a groove is formed about said tubular housing and adjacent said open end thereof, a resilient band retained in said groove, said collapsible liquid container having at least one skirt secured thereto adjacent a nipple end thereof, said skirt being engageable between said resilient band and an inner face of said clamping ring.

* * * * *